US010925347B2

(12) United States Patent
Smith et al.

(10) Patent No.: US 10,925,347 B2
(45) **Date of Patent: *Feb. 23, 2021**

(54) SHOE SOLE

(71) Applicant: adidas AG, Herzogenaurach (DE)

(72) Inventors: Paul Leonard Michael Smith, Herzogenaurach (DE); James Tarrier, Herzogenaurach (DE); Angus Wardlaw, Herzogenaurach (DE); Heiko Schlarb, Herzogenaurach (DE)

(73) Assignee: adidas AG, Herzogenaurach (DE)

( * ) Notice: Subject to any disclaimer, the term of this patent is extended or adjusted under 35 U.S.C. 154(b) by 174 days.

This patent is subject to a terminal disclaimer.

(21) Appl. No.: 14/823,227

(22) Filed: Aug. 11, 2015

(65) Prior Publication Data

US 2016/0037859 A1 Feb. 11, 2016

(30) Foreign Application Priority Data

Aug. 11, 2014 (DE) ..... 10 2014 215 897.4

(51) Int. Cl.
*A43B 13/16* (2006.01)
*A43B 13/02* (2006.01)
(Continued)

(52) U.S. Cl.
CPC ..... *A43B 13/16* (2013.01); *A43B 5/00* (2013.01); *A43B 13/02* (2013.01); *A43B 13/026* (2013.01);
(Continued)

(58) Field of Classification Search
CPC ..... A43B 5/00; A43B 13/02; A43B 13/141; A43B 13/16; A43B 13/186; A43B 13/187;
(Continued)

(56) References Cited

U.S. PATENT DOCUMENTS

D64,898 S 6/1924 Gunlock
2,131,756 A 10/1938 Roberts
(Continued)

FOREIGN PATENT DOCUMENTS

CN 1034662 8/1989
CN 1036128 10/1989
(Continued)

OTHER PUBLICATIONS

"https://www.britannica.com/print/article/463684", Aug. 17, 2016, 15 pgs.
(Continued)

*Primary Examiner* — Sharon M Prange

(74) *Attorney, Agent, or Firm* — Kilpatrick Townsend & Stockton LLP

(57) ABSTRACT

Described are soles for shoes, and shoes with such soles. The sole includes a first partial region and a second partial region, a cushioning element, and a protection element. The cushioning element is arranged within at least a portion of the first partial region and within at least a portion of the second partial region. The protection element is also arranged within at least a portion of the first partial region and within at least a portion of the second partial region. The cushioning element has a greater stiffness in the first partial region than in the second partial region. When a wearer treads down with the sole on a surface, the protection element has a larger contact area with the surface in the first partial region than in the second partial region.

21 Claims, 2 Drawing Sheets

(51) Int. Cl.

| | |
|---|---|
| ***A43B 13/18*** | (2006.01) |
| ***A43C 15/16*** | (2006.01) |
| ***A43B 13/14*** | (2006.01) |
| ***A43B 5/00*** | (2006.01) |

(52) U.S. Cl.
CPC ..... *A43B 13/141* (2013.01); *A43B 13/186* (2013.01); *A43B 13/187* (2013.01); *A43B 13/188* (2013.01); *A43C 15/168* (2013.01)

(58) Field of Classification Search
CPC .... A43B 13/188; A43B 13/026; A43C 15/168
USPC ..... 36/25 R, 30 R, 31, 59 C
See application file for complete search history.

(56) References Cited

U.S. PATENT DOCUMENTS

| | | | | | |
|---|---|---|---|---|---|
| 2,968,106 | A | | 1/1961 | Joiner et al. | |
| 3,186,013 | A | | 6/1965 | Glassman et al. | |
| 3,586,003 | A | | 6/1971 | Baker | |
| 3,834,046 | A | | 9/1974 | Fowler | |
| D237,323 | S | | 10/1975 | Inohara | |
| 4,132,016 | A | | 1/1979 | Vaccari | |
| 4,237,627 | A | * | 12/1980 | Turner | A43B 5/06 36/129 |
| 4,364,189 | A | * | 12/1982 | Bates | A43B 5/06 36/129 |
| 4,481,727 | A | | 11/1984 | Stubblefield et al. | |
| 4,524,529 | A | | 6/1985 | Schaefer | |
| 4,546,559 | A | | 10/1985 | Dassler et al. | |
| 4,624,062 | A | | 11/1986 | Autry | |
| 4,642,911 | A | | 2/1987 | Talarico, II | |
| 4,658,515 | A | | 4/1987 | Oatman et al. | |
| 4,667,423 | A | | 5/1987 | Autry et al. | |
| D296,262 | S | | 6/1988 | Brown et al. | |
| 4,754,561 | A | * | 7/1988 | Dufour | A43B 13/188 36/127 |
| 4,798,010 | A | * | 1/1989 | Sugiyama | A43B 13/12 36/28 |
| D302,898 | S | | 8/1989 | Greenberg | |
| RE33,066 | E | | 9/1989 | Stubblefield | |
| 4,864,739 | A | * | 9/1989 | Maestri | A43B 7/142 12/146 M |
| 4,922,631 | A | | 5/1990 | Anderie | |
| 4,970,807 | A | | 11/1990 | Anderie et al. | |
| 5,025,573 | A | | 6/1991 | Giese et al. | |
| D329,731 | S | | 9/1992 | Adcock et al. | |
| 5,150,490 | A | | 9/1992 | Busch et al. | |
| D333,556 | S | | 3/1993 | Purdom | |
| D337,650 | S | | 7/1993 | Thomas, III et al. | |
| D340,797 | S | | 11/1993 | Pallera et al. | |
| 5,283,963 | A | | 2/1994 | Lerner et al. | |
| 5,308,420 | A | | 5/1994 | Yang et al. | |
| 5,319,866 | A | | 6/1994 | Foley et al. | |
| D350,016 | S | | 8/1994 | Passke et al. | |
| D350,222 | S | | 9/1994 | Hase | |
| D356,438 | S | | 3/1995 | Opie et al. | |
| 5,528,842 | A | | 6/1996 | Ricci et al. | |
| 5,549,743 | A | | 8/1996 | Pearce et al. | |
| D375,619 | S | | 11/1996 | Backus et al. | |
| 5,617,650 | A | | 4/1997 | Grim | |
| 5,619,809 | A | | 4/1997 | Sessa | |
| 5,692,319 | A | | 12/1997 | Parker et al. | |
| 5,709,954 | A | | 1/1998 | Lyden et al. | |
| D389,991 | S | | 2/1998 | Elliott | |
| D390,349 | S | | 2/1998 | Murai et al. | |
| D393,340 | S | | 4/1998 | Doxey | |
| D395,337 | S | | 6/1998 | Greene | |
| D408,618 | S | | 4/1999 | Wilborn et al. | |
| D408,971 | S | | 5/1999 | Birkenstock | |
| D413,010 | S | | 8/1999 | Birkenstock | |
| 5,932,336 | A | | 8/1999 | Petrovic et al. | |
| D414,920 | S | | 10/1999 | Cahill | |
| D415,610 | S | | 10/1999 | Cahill | |
| D415,876 | S | | 11/1999 | Cahill | |
| 5,996,252 | A | | 12/1999 | Cougar | |
| 6,014,821 | A | | 1/2000 | Yaw | |
| 6,041,521 | A | | 3/2000 | Wong | |
| D422,400 | S | | 4/2000 | Brady et al. | |
| D423,199 | S | | 4/2000 | Cahill | |
| 6,108,943 | A | * | 8/2000 | Hudson | A43B 5/10 36/102 |
| D431,346 | S | | 10/2000 | Birkenstock | |
| 6,266,896 | B1 | | 7/2001 | Liu | |
| D460,852 | S | | 7/2002 | Daudier | |
| 6,516,540 | B2 | | 2/2003 | Seydel et al. | |
| 6,702,469 | B1 | | 3/2004 | Taniguchi et al. | |
| 6,708,426 | B2 | | 3/2004 | Erickson et al. | |
| D490,222 | S | | 5/2004 | Burg et al. | |
| D490,230 | S | | 5/2004 | Mervar | |
| D492,099 | S | | 6/2004 | McClaskie | |
| 6,782,640 | B2 | | 8/2004 | Westin et al. | |
| 6,796,056 | B2 | | 9/2004 | Swigart | |
| D498,901 | S | | 11/2004 | Hawker et al. | |
| 6,849,667 | B2 | | 2/2005 | Haseyama et al. | |
| 6,874,257 | B2 | | 4/2005 | Erickson | |
| 6,925,734 | B1 | | 8/2005 | Schaeffer et al. | |
| 6,948,263 | B2 | | 9/2005 | Covatch | |
| 6,957,504 | B2 | | 10/2005 | Morris | |
| 6,968,637 | B1 | | 11/2005 | Johnson et al. | |
| D517,302 | S | | 3/2006 | Ardissono | |
| 7,073,277 | B2 | | 7/2006 | Erb et al. | |
| 7,143,529 | B2 | | 12/2006 | Robinson et al. | |
| D538,518 | S | | 3/2007 | Della Valle | |
| 7,202,284 | B1 | | 4/2007 | Limerkens et al. | |
| 7,243,445 | B2 | | 7/2007 | Manz et al. | |
| D554,848 | S | | 11/2007 | Marston | |
| D560,883 | S | | 2/2008 | McClaskie | |
| D561,433 | S | | 2/2008 | McClaskie | |
| D561,438 | S | | 2/2008 | Belley | |
| D561,986 | S | | 2/2008 | Horne et al. | |
| D570,581 | S | | 6/2008 | Polegato Moretti | |
| D571,085 | S | | 6/2008 | McClaskie | |
| D572,462 | S | | 7/2008 | Hatfield et al. | |
| 7,421,805 | B2 | | 9/2008 | Geer | |
| D586,090 | S | | 2/2009 | Turner et al. | |
| D589,690 | S | | 4/2009 | Truelsen | |
| D594,187 | S | | 6/2009 | Hickman | |
| D596,384 | S | | 7/2009 | Andersen et al. | |
| D601,333 | S | | 10/2009 | McClaskie | |
| D606,733 | S | | 12/2009 | McClaskie | |
| D607,190 | S | | 1/2010 | McClaskie | |
| D611,233 | S | | 3/2010 | Della Valle et al. | |
| 7,673,397 | B2 | | 3/2010 | Jarvis | |
| D616,183 | S | | 5/2010 | Skaja | |
| D617,540 | S | | 6/2010 | McClaskie | |
| D618,891 | S | | 7/2010 | McClaskie | |
| D631,646 | S | | 2/2011 | Müller | |
| D633,286 | S | | 3/2011 | Skaja | |
| D633,287 | S | | 3/2011 | Skaja | |
| D634,918 | S | | 3/2011 | Katz et al. | |
| D636,156 | S | | 4/2011 | Della Valle et al. | |
| D636,569 | S | | 4/2011 | McMillan | |
| D636,571 | S | | 4/2011 | Avar | |
| 7,941,941 | B2 | | 5/2011 | Hazenberg et al. | |
| D641,142 | S | | 7/2011 | Lindseth et al. | |
| D644,827 | S | | 9/2011 | Lee | |
| D645,649 | S | | 9/2011 | McClaskie | |
| D648,105 | S | | 11/2011 | Schlageter et al. | |
| D650,159 | S | | 12/2011 | Avar | |
| 8,082,684 | B2 | | 12/2011 | Munns | |
| D655,488 | S | | 3/2012 | Blakeslee | |
| D659,364 | S | | 5/2012 | Jolicoeur | |
| 8,186,081 | B2 | | 5/2012 | Wilson, III | |
| 8,205,357 | B2 | | 6/2012 | Keating et al. | |
| D680,725 | S | | 4/2013 | Avar et al. | |
| D680,726 | S | | 4/2013 | Propét | |
| D683,116 | S | | 5/2013 | Petrie | |
| 8,479,412 | B2 | | 7/2013 | Peyton et al. | |
| 8,490,297 | B2 | | 7/2013 | Guerra | |
| D693,553 | S | | 11/2013 | McClaskie | |
| D695,501 | S | | 12/2013 | Yehudah | |
| D698,137 | S | | 1/2014 | Carr | |

(56) References Cited

U.S. PATENT DOCUMENTS

D707,934 S 7/2014 Petrie
D709,680 S 7/2014 Herath
8,834,770 B2 9/2014 Nakano et al.
D721,478 S 1/2015 Avent et al.
9,010,157 B1 4/2015 Podhajny et al.
D739,129 S 9/2015 Del Biondi
D739,131 S 9/2015 Del Biondi
D740,003 S 10/2015 Herath
D740,004 S 10/2015 Hoellmueller et al.
9,167,868 B1 10/2015 Koo et al.
9,167,869 B2 10/2015 Koo et al.
9,212,270 B2 12/2015 Künkel et al.
D758,056 S 6/2016 Herath et al.
9,516,918 B2 * 12/2016 Meschter ..... A43B 13/18
D776,410 S 1/2017 Herath et al.
D783,264 S 4/2017 Hoellmueller et al.
9,781,970 B2 10/2017 Wardlaw et al.
9,781,974 B2 10/2017 Reinhardt
9,788,598 B2 10/2017 Reinhardt
9,788,606 B2 10/2017 Reinhardt
9,820,528 B2 11/2017 Reinhardt et al.
9,849,645 B2 12/2017 Wardlaw et al.
9,968,157 B2 5/2018 Wardlaw et al.
10,039,342 B2 8/2018 Reinhardt et al.
10,259,183 B2 4/2019 Wardlaw et al.
2002/0162247 A1 11/2002 Hokkirigawa et al.
2003/0131501 A1 7/2003 Erickson et al.
2003/0158275 A1 8/2003 McClelland et al.
2003/0172548 A1 9/2003 Fuerst et al.
2003/0208925 A1 11/2003 Pan
2004/0032042 A1 2/2004 Chi
2004/0138318 A1 7/2004 McClelland et al.
2004/0211088 A1 10/2004 Volkart
2005/0065270 A1 3/2005 Knoerr et al.
2005/0108898 A1 5/2005 Jeppesen et al.
2005/0150132 A1 7/2005 Iannacone
2005/0241181 A1 11/2005 Cheng
2006/0010717 A1 1/2006 Finkelstein
2006/0026863 A1 2/2006 Liu
2006/0083912 A1 4/2006 Park et al.
2006/0125134 A1 6/2006 Lin et al.
2006/0134351 A1 6/2006 Greene et al.
2006/0156579 A1 7/2006 Hoffer et al.
2006/0235095 A1 10/2006 Leberfinger et al.
2006/0283046 A1 12/2006 Mason
2007/0193070 A1 8/2007 Bertagna et al.
2007/0199213 A1 8/2007 Campbell et al.
2007/0295451 A1 12/2007 Willis
2008/0052965 A1 3/2008 Sato et al.
2008/0060221 A1 3/2008 Hottinger et al.
2008/0244932 A1 10/2008 Nau et al.
2008/0250666 A1 10/2008 Votolato
2009/0013558 A1 1/2009 Hazenberg et al.
2009/0025260 A1 1/2009 Nakano
2009/0113758 A1 5/2009 Nishiwaki et al.
2009/0119023 A1 5/2009 Zimmer et al.
2009/0217550 A1 9/2009 Koo et al.
2009/0235557 A1 9/2009 Christensen et al.
2009/0277047 A1 11/2009 Polegato Moretti
2009/0293309 A1 12/2009 Keating et al.
2009/0320330 A1 12/2009 Borel et al.
2010/0063778 A1 3/2010 Schrock et al.
2010/0122472 A1 5/2010 Wilson, III et al.
2010/0154257 A1 6/2010 Bosomworth et al.
2010/0218397 A1 9/2010 Nishiwaki et al.
2010/0222442 A1 9/2010 Prissok et al.
2010/0229426 A1 9/2010 Brown
2010/0242309 A1 9/2010 McCann
2010/0287788 A1 11/2010 Spanks et al.
2010/0287795 A1 11/2010 Van Niekerk
2010/0293811 A1 11/2010 Truelsen et al.
2011/0047720 A1 3/2011 Maranan et al.
2011/0067272 A1 3/2011 Lin
2011/0146110 A1 6/2011 Geer
2011/0232135 A1 * 9/2011 Dean ..... A43B 13/04 36/25 R
2011/0252668 A1 10/2011 Chen
2011/0283560 A1 * 11/2011 Portzline ..... A43B 13/04 36/31
2011/0302805 A1 12/2011 Vito
2012/0005920 A1 1/2012 Alvear et al.
2012/0047770 A1 3/2012 Dean et al.
2012/0059075 A1 3/2012 Prissok et al.
2012/0073160 A1 * 3/2012 Marvin ..... A43B 13/186 36/28
2012/0177777 A1 7/2012 Brown et al.
2012/0204449 A1 8/2012 Stockbridge et al.
2012/0233877 A1 * 9/2012 Swigart ..... A43B 7/223 36/28
2012/0233883 A1 9/2012 Spencer et al.
2012/0235322 A1 9/2012 Greene et al.
2012/0266490 A1 10/2012 Atwal et al.
2012/0304491 A1 12/2012 Kimura et al.
2013/0019505 A1 1/2013 Borel et al.
2013/0150468 A1 6/2013 Füssi et al.
2013/0255103 A1 10/2013 Dua et al.
2013/0266792 A1 10/2013 Nohara et al.
2013/0269215 A1 10/2013 Smirman et al.
2013/0291409 A1 11/2013 Reinhardt et al.
2014/0017450 A1 1/2014 Baghdadi et al.
2014/0033573 A1 2/2014 Wills
2014/0066530 A1 3/2014 Shen et al.
2014/0075787 A1 3/2014 Cartagena
2014/0197253 A1 7/2014 Lofts et al.
2014/0223673 A1 8/2014 Wardlaw et al.
2014/0223776 A1 8/2014 Wardlaw et al.
2014/0223777 A1 * 8/2014 Whiteman ..... A43B 13/125 36/102
2014/0223783 A1 8/2014 Wardlaw et al.
2014/0227505 A1 8/2014 Schiller et al.
2014/0325871 A1 11/2014 Price et al.
2014/0366403 A1 12/2014 Reinhardt et al.
2014/0366404 A1 12/2014 Reinhardt et al.
2014/0366405 A1 12/2014 Reinhardt et al.
2014/0373392 A1 12/2014 Cullen
2015/0082668 A1 * 3/2015 Nonogawa ..... A43B 5/10 36/30 R
2015/0089841 A1 4/2015 Smaldone et al.
2015/0166270 A1 6/2015 Buscher et al.
2015/0174808 A1 6/2015 Rudolph et al.
2015/0197617 A1 7/2015 Prissok et al.
2015/0237823 A1 8/2015 Schmitt et al.
2015/0313310 A1 * 11/2015 Okamoto ..... A43B 13/14 36/31
2015/0344661 A1 12/2015 Spies et al.
2015/0351493 A1 12/2015 Ashcroft et al.
2016/0044992 A1 2/2016 Reinhardt et al.
2016/0046751 A1 2/2016 Spies et al.
2016/0121524 A1 5/2016 Däschlein et al.
2016/0128426 A1 5/2016 Reinhardt et al.
2016/0227876 A1 8/2016 Le et al.
2016/0244583 A1 8/2016 Keppeler
2016/0244584 A1 8/2016 Keppeler
2016/0244587 A1 8/2016 Gutmann et al.
2016/0346627 A1 12/2016 Le et al.
2017/0173910 A1 6/2017 Wardlaw et al.
2017/0253710 A1 9/2017 Smith et al.
2017/0259474 A1 9/2017 Holmes et al.
2017/0340067 A1 11/2017 Dyckmans et al.
2017/0341325 A1 11/2017 Le et al.
2017/0341326 A1 11/2017 Holmes et al.
2017/0341327 A1 11/2017 Le et al.
2018/0000197 A1 1/2018 Wardlaw et al.
2018/0035755 A1 2/2018 Reinhardt et al.
2018/0154598 A1 6/2018 Kurtz et al.
2018/0206591 A1 7/2018 Whiteman et al.
2018/0235310 A1 8/2018 Wardlaw et al.

(56) References Cited

U.S. PATENT DOCUMENTS

| | | | |
|---|---|---|---|
| 2018/0290349 | A1 | 10/2018 | Kirupanantham et al. |
| 2018/0303198 | A1 | 10/2018 | Reinhardt et al. |

FOREIGN PATENT DOCUMENTS

| | | | |
|---|---|---|---|
| CN | 2511160 | | 9/2002 |
| CN | 1451332 | | 10/2003 |
| CN | 2722676 | | 9/2005 |
| CN | 2796454 | | 7/2006 |
| CN | 2888936 | | 4/2007 |
| CN | 101003679 | | 7/2007 |
| CN | 101107113 | | 1/2008 |
| CN | 101190049 | | 6/2008 |
| CN | 201223028 | | 4/2009 |
| CN | 101484035 | | 7/2009 |
| CN | 101611950 | | 12/2009 |
| CN | 202233324 | | 5/2012 |
| CN | 202635746 | | 1/2013 |
| CN | 102970891 | A | 3/2013 |
| CN | 202907958 | | 5/2013 |
| CN | 103371564 | | 10/2013 |
| CN | 203262404 | | 11/2013 |
| CN | 203692653 | | 7/2014 |
| CN | 203828180 | | 9/2014 |
| CN | 104640468 | | 5/2015 |
| DE | 3605662 | | 6/1987 |
| DE | 4236081 | | 4/1994 |
| DE | 29718491 | | 2/1998 |
| DE | 19652690 | | 6/1998 |
| DE | 19950121 | | 11/2000 |
| DE | 10010182 | | 9/2001 |
| DE | 10244433 | | 12/2005 |
| DE | 10244435 | | 2/2006 |
| DE | 102004063803 | | 7/2006 |
| DE | 102005050411 | | 4/2007 |
| DE | 202008017042 | | 4/2009 |
| DE | 102008020890 | | 10/2009 |
| DE | 102009004386 | | 7/2010 |
| DE | 202010008893 | | 1/2011 |
| DE | 202010015777 | | 1/2011 |
| DE | 112009001291 | | 4/2011 |
| DE | 102010052783 | | 5/2012 |
| DE | 202012005735 | | 8/2012 |
| DE | 102011108744 | | 1/2013 |
| DE | 102012206094 | | 10/2013 |
| DE | 102013202291 | | 8/2014 |
| DE | 102013202353 | | 8/2014 |
| DE | 102013208170 | | 11/2014 |
| EM | 001286116-0001 | | 7/2011 |
| EM | 001286116-0002 | | 7/2011 |
| EM | 001286116-0003 | | 7/2011 |
| EM | 001286116-0004 | | 7/2011 |
| EM | 001286116-0005 | | 7/2011 |
| EM | 001286116-0006 | | 7/2011 |
| EP | 0165353 | | 12/1985 |
| EP | 752216 | | 1/1997 |
| EP | 873061 | | 10/1998 |
| EP | 1197159 | | 4/2002 |
| EP | 1424105 | | 6/2004 |
| EP | 1402796 | | 1/2006 |
| EP | 1854620 | | 11/2007 |
| EP | 1872924 | | 1/2008 |
| EP | 2110037 | A1 | 10/2009 |
| EP | 2233021 | | 9/2010 |
| EP | 2250917 | | 11/2010 |
| EP | 2316293 | | 5/2011 |
| EP | 2342986 | | 7/2011 |
| EP | 2446768 | | 5/2012 |
| EP | 2649896 | | 10/2013 |
| EP | 2540184 | B1 | 7/2014 |
| EP | 2792261 | A1 | 10/2014 |
| EP | 2848144 | | 3/2015 |
| EP | 2939558 | | 11/2015 |
| EP | 3067100 | | 9/2016 |
| ES | 1073997 | | 6/2011 |
| FR | 2683432 | | 5/1993 |
| GB | 2258801 | | 2/1993 |
| JP | S63-159501 | | 10/1988 |
| JP | 01274705 | | 11/1989 |
| JP | 2913603 | | 6/1999 |
| JP | 2000197503 | | 7/2000 |
| JP | 2002238609 | | 8/2002 |
| JP | 2002-325602 | | 11/2002 |
| JP | 2002361749 | | 12/2002 |
| JP | 2005218543 | | 8/2005 |
| JP | 2008073548 | | 4/2008 |
| JP | 2008532618 | | 8/2008 |
| JP | 2009-142705 | | 7/2009 |
| JP | 2009527326 | | 7/2009 |
| JP | 2009-535157 | | 10/2009 |
| JP | 2011177403 | | 9/2011 |
| JP | 2012-249744 | | 12/2012 |
| KR | 1020110049293 | | 5/2011 |
| TW | 201012407 | | 4/2010 |
| WO | 8906501 | | 7/1989 |
| WO | 1994020568 | A1 | 9/1994 |
| WO | 2002/008322 | | 1/2002 |
| WO | 2005023920 | | 3/2005 |
| WO | 2005026243 | A1 | 3/2005 |
| WO | 2005066250 | | 7/2005 |
| WO | 2006015440 | | 2/2006 |
| WO | 2006027671 | | 3/2006 |
| WO | 2006/034807 | A1 | 4/2006 |
| WO | 2006038357 | | 4/2006 |
| WO | 2006090221 | | 8/2006 |
| WO | 2007082838 | | 7/2007 |
| WO | 2007100451 | | 9/2007 |
| WO | 2008047538 | A1 | 4/2008 |
| WO | 2008087078 | | 7/2008 |
| WO | 2009039555 | | 4/2009 |
| WO | 2009095935 | | 8/2009 |
| WO | 2009146368 | | 12/2009 |
| WO | 2010010010 | | 1/2010 |
| WO | 2010037028 | | 4/2010 |
| WO | 2010045144 | | 4/2010 |
| WO | 2010136398 | | 12/2010 |
| WO | 2011134996 | A1 | 11/2011 |
| WO | 2012065926 | | 5/2012 |
| WO | 2013013784 | | 1/2013 |
| WO | 2013168256 | | 11/2013 |
| WO | 2014046940 | | 3/2014 |
| WO | 2014/119774 | A1 | 8/2014 |
| WO | 2015052265 | A1 | 4/2015 |
| WO | 2015052267 | A1 | 4/2015 |
| WO | 2015075546 | A1 | 5/2015 |

OTHER PUBLICATIONS

Office Action, Chinese Patent Application No. 201510490042.2, dated Sep. 27, 2016, 6 pages.

U.S. Appl. No. 29/558,138, filed Mar. 15, 2016, Hoellmueller et al.

U.S. Appl. No. 15/078,043, filed Mar. 23, 2016, Tru, Huu Minh L.

U.S. Appl. No. 15/130,012, filed Apr. 15, 2016, Kormann, Marco et al.

U.S. Appl. No. 14/891,168, filed Dec. 28, 2015, Reinhardt et al.

U.S. Appl. No. 29/464,051, filed Aug. 12, 2013, Galway.

U.S. Appl. No. 62/137,139, filed Mar. 23, 2015, Gordon et al.

U.S. Appl. No. 29/550,418, filed Jan. 4, 2016, Galway et al.

Amesöder et al., "The right turn (part 1)—Determination of Characteristic values for assembly injection molding", Journal of Plastics Technology, Apr. 2008, pp. 1-8 (English translation of Abstract provided).

Baur et al., "Saechtling Kunststoff Taschenbuch", Hanser Verlag, 31. Ausgabe, Oct. 2013, 18 pages (9 pages for the original document and 9 pages for the English translation).

European Application No. 15180122.2, Extended European Search Report dated Jan. 15, 2016, 9 pages.

Venable LLP, Letter, dated Jan. 14, 2016, 6 pages.

German Patent Application No. 102014215897.4, Office Action dated Jun. 18, 2015, 8 pages (no English translation available. A summary of the Office Action is provided in the Transmittal Letter submitted herewith).

(56) References Cited

OTHER PUBLICATIONS

U.S. Appl. No. 15/093,233, Wardlaw, Angus et al.
"Colour and Additive Preparations for Extruded Polyolefin Foams", Gabriel-Chemie Group, available at www.gabriel-chemie.com/downloads/folder/PE%20foams_en.pdf, last accessed on Jan. 17, 2017, 20 pages.
"http://www.dow.com/polyethylene/na/en/fab/foaming.htm", Dec. 7, 2011, 1 page.
Nauta , "Stabilisation of Low Density, Closed Cell Polyethylene Foam", University of Twente, Netherlands, 2000, 148 pages.
Third Party Submission, U.S. Appl. No. 14/981,168, Nov. 14, 2016, 44 pages.
U.S. Appl. No. 15/703,031, Unpublished (filed Sep. 13, 2017).
U.S. Appl. No. 15/724,318, Unpublished (filed Oct. 4, 2017).
U.S. Appl. No. 15/581,112, Unpublished (filed Apr. 28, 2017).
U.S. Appl. No. 29/591,016 , Unpublished (filed Jan. 16, 2017).
U.S. Appl. No. 29/592,935 , Unpublished (filed Feb. 3, 2017).
U.S. Appl. No. 29/592,946 , Unpublished (filed Feb. 3, 2017).
U.S. Appl. No. 29/594,228 , Unpublished (filed Feb. 16, 2017).
U.S. Appl. No. 29/594,358, Unpublished (filed Feb. 17, 2017).
U.S. Appl. No. 29/595,852, Unpublished (filed Mar. 2, 2017).
U.S. Appl. No. 29/595,857, Unpublished (filed Mar. 2, 2017).
U.S. Appl. No. 29/595,859, Unpublished (filed Mar. 2, 2017).
U.S. Appl. No. 29/614,532, Unpublished (filed Aug. 21, 2017).
U.S. Appl. No. 29/614,545, Unpublished (filed Aug. 21, 2017).
Office Action, Chinese Patent Application No. 201510490042.2, dated Jun. 2, 2017.
AZO Materials , "BASF Develops Expanded Thermoplastic Polyurethane", available http://www.azom.com/news.aspxNEWSID=37360, Jul. 2, 2013, 4 pages.
Office Action, Japanese Patent Application No. 2015-158367, dated Aug. 14, 2018, 6 pages
Office Action, German Patent Application No. 10 2014 019 786.7, dated Dec. 3, 2018, 10 pages.
U.S. Appl. No. 16/139,797, filed Sep. 24, 2018, Unpublished.
U.S. Appl. No. 16/353,374, filed Mar. 14, 2019, Unpublished.
U.S. Appl. No. 29/664,097, filed Sep. 21, 2018, Unpublished.
U.S. Appl. No. 29/643,233, filed Apr. 5, 2018, Unpublished.
U.S. Appl. No. 29/641,256, filed Mar. 20, 2018, Unpublished.
U.S. Appl. No. 29/641,371, filed Mar. 21, 2018, Unpublished.
U.S. Appl. No. 29/663,029, filed Sep. 11, 2018, Unpublished.
U.S. Appl. No. 29/663,342, filed Sep. 13, 2018, Unpublished.
U.S. Appl. No. 29/679,962, filed Feb. 12, 2019, Unpublished.
U.S. Appl. No. 29/706,274, filed Sep. 19, 2019, Unpublished.
U.S. Appl. No. 29/719,889, filed Jan. 8, 2020, Unpublished.
U.S. Appl. No. 29/721,029, filed Jan. 17, 2020, Unpublished.
Office Action, Chinese Patent Application No. 201510490042.2, dated Nov. 8, 2017, 15 pages.
Office Action, Chinese Patent Application No. 201510490042.2, dated Jul. 3, 2018, 9 pages.
Decision to Grant, Japanese Patent Application No. 2015-158367, dated Apr. 2, 2019, 5 pages.
Decision to Grant, German Patent Application No. 102014215897.4, dated Sep. 5, 2016, 13 pages.
U.S. Appl. No. 29/691,854, filed May 20, 2019, Unpublished.
U.S. Appl. No. 29/691,166, filed May 14, 2019, Unpublished.
U.S. Appl. No. 29/694,634, filed Jun. 12, 2019, Unpublished.
U.S. Appl. No. 29/697,489, filed Jul. 9, 2019, Unpublished.
U.S. Appl. No. 29/693,455, filed Jun. 3, 2019, Unpublished.
U.S. Appl. No. 16/465,485, filed May 30, 2019, Unpublished.
U.S. Appl. No. 16/680,852, filed Nov. 12, 2019, Unpublished.
Office Action, Japanese Patent Application No. 2019-085402, dated Apr. 21, 2020, 6 pages.
Office Action, Chinese Patent Application No. 201910237406.4, dated Dec. 7, 2020.
Office Action, Chinese Patent Application No. 201910246458.8, dated Nov. 20, 2020.

* cited by examiner

SHOE SOLE

CROSS REFERENCE TO RELATED APPLICATION

This application is related to and claims priority benefits from German Patent Application No. DE 10 2014 215 897.4, filed on Aug. 11, 2014, entitled ADISTAR BOOST ("the '897 application"). The '897 application is hereby incorporated herein in its entirety by this reference.

FIELD OF THE INVENTION

The present invention relates to a sole for a shoe, in particular a sports shoe, as well as a shoe with such a sole.

BACKGROUND

The design of a shoe sole allows providing a shoe with a plurality of different properties which may be developed to different degrees depending on the kind of shoe.

First, a shoe sole typically comprises a protective function. It protects the foot by its increased hardness with respect to the shaft of the shoe from injuries, for example caused by pointed objects on which the wearer may tread. Furthermore, a shoe sole typically protects the shoe from excessive use by an increased abrasion resistance. In addition, a shoe sole may increase the grip of the shoe on the respective surface and thus facilitate faster movements. These functionalities may, for example, be provided by an outsole.

It may be a further function of the shoe sole to provide a certain stability to the foot during the gait cycle. Moreover, the shoe sole may have a cushioning effect, e.g. to absorb the forces acting during impact of the shoe with the surface, wherein it may be beneficial if the energy expended for the deformation of the sole is at least partially returned to the foot of the wearer and is thus not lost. These functionalities may, for example, be provided by a midsole.

To this end, e.g. in the DE 10 2012 206 094 A1 and the EP 2 649 896 A2 shoe soles and methods for their manufacture are described which comprise randomly arranged particles of an expanded material, in particular expanded thermoplastic polyurethane (eTPU), and distinguish themselves by a particular high energy return to the foot of the wearer. Furthermore, the WO 2005/066250 A1 describes methods for the manufacture of shoes wherein the shoe shaft is adhesively connected with a sole on the basis of foamed thermoplastic urethane.

However, it is a disadvantage of conventional soles that they often comprise mid- or outsoles, respectively, which are uniformly designed and which are only inadequately adapted to the different loads acting on the sole and the musculoskeletal system of the wearer during different phases of a gait cycle.

Starting from the prior art, it is therefore an objective of the present invention to provide improved soles for shoes, in particular soles for sports shoes, which are more adequately adapted to the loads occurring during a gait cycle and acting on the sole and on the musculoskeletal system of the wearer.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various embodiments of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

According to certain embodiments of the present invention, a sole for a shoe comprises a first partial region and a second partial region, a cushioning element arranged within at least a portion of the first partial region and within at least a portion of the second partial region, and a protection element arranged within at least a portion of the first partial region and within at least a portion of the second partial region, wherein the cushioning element comprises a greater stiffness in the first partial region than in the second partial region, and wherein when a wearer treads down with the sole on a surface, the protection element comprises a larger contact area with the surface in the first partial region than in the second partial region.

In certain embodiments, the protection element is arranged beneath the cushioning element and directly at the cushioning element.

In some embodiments, the sole further comprises a midsole, and the cushioning element forms at least a portion of the midsole. In further embodiments, the sole further comprises a outsole, and the protection element forms at least a portion of the outsole.

The cushioning element may comprise a greater density in the first partial region than in the second partial region.

According to some embodiments, the cushioning element comprises randomly arranged particles of an expanded material. The particles of the expanded material may be selected from a group consisting of expanded thermoplastic polyurethane particles and expanded polyether-block-amide particles.

In some embodiments, the cushioning element further comprises a reinforcing element. The reinforcing element may extend into the first partial region and the second partial region.

The protection element may comprise a greater bending stiffness in the first partial region than in the second partial region. In some embodiments, the protection element comprises at least one first protrusion in the first partial region, wherein the at least one first protrusion comprises a flattened surface. In further embodiments, the protection element comprises at least one second protrusion in the second partial region, wherein the at least one second protrusion at least partially presses into the cushioning element when the wearer treads down on the sole.

The first partial region may extend on at least a portion of a medial side of the sole. The second partial region may extend on at least a portion of a lateral side of the sole.

In certain embodiments, a shoe may comprise a sole as described above.

According to certain embodiments of the present invention, a sole for a shoe comprises a first partial region and a second partial region, a cushioning element arranged within at least a portion of the first partial region and within at least a portion of the second partial region, and a protection element arranged within at least a portion of the first partial region and within at least a portion of the second partial region, wherein the cushioning element comprises a greater stiffness in the first partial region than in the second partial region, and wherein the protection element comprises a plurality of openings or regions of thinner material in the first partial region and in the second partial region, wherein on average, the plurality of openings or the regions of thinner material in the second partial region occupy a larger area than the plurality of openings or the regions of thinner material in the first partial region.

In some embodiments, the protection element comprises the plurality of openings and the regions of thinner material in the second partial region, wherein on average, the plurality of openings and the regions of thinner material in the second partial region occupy a larger area than the plurality of openings or the regions of thinner material in the first partial region.

The protection element may also comprise the plurality of openings and the regions of thinner material in the first partial region, wherein on average, the plurality of openings and the regions of thinner material in the second partial region occupy a larger area than the plurality of openings and the regions of thinner material in the first partial region.

According to some embodiments, the cushioning element comprises randomly arranged particles of an expanded material. The particles of the expanded material may be selected from a group consisting of expanded thermoplastic polyurethane particles and expanded polyether-block-amide particles.

BRIEF DESCRIPTION OF THE DRAWINGS

In the following detailed description, embodiments of the invention are described referring to the following figures.

BRIEF DESCRIPTION

Figure 1A:
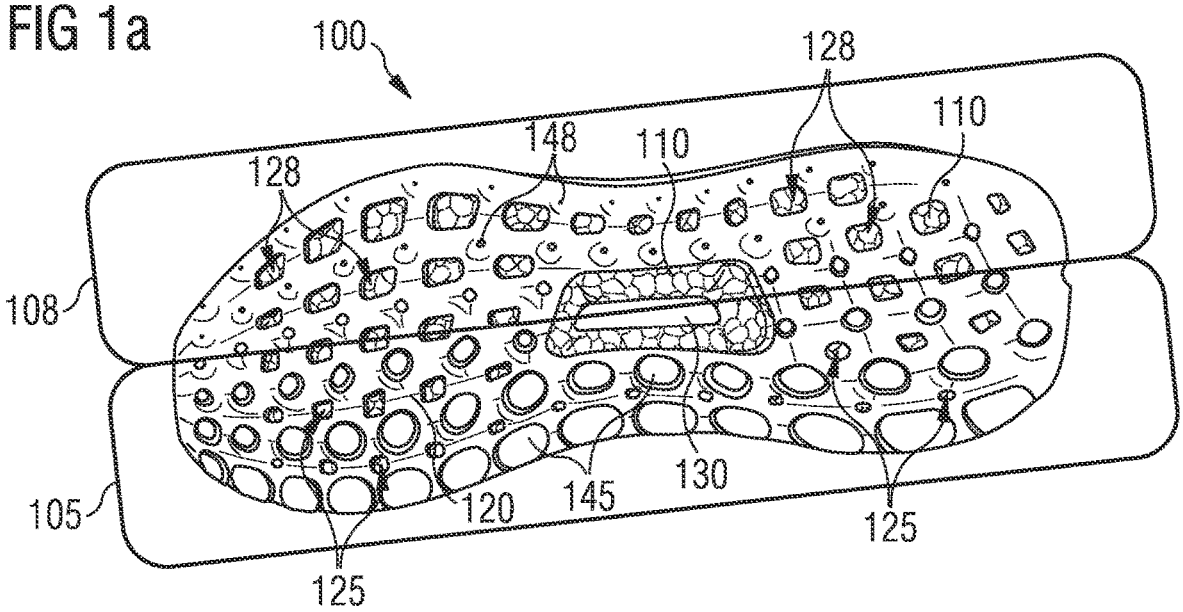
FIGS. 1*a*-1*c* are bottom views of shoe soles, according to certain embodiments of the present invention.

According to an aspect of the present invention this objective is at least partially solved by a sole for a shoe, in particular a sole for a sports shoe, which comprises a cushioning element and a protection element. Herein, the sole comprises a first partial region and a second partial region, wherein the cushioning element comprises a greater stiffness in the first partial region than in the second partial region and wherein, when treading down with the sole on a surface, the protection element comprises a larger contact area with the surface in the first partial region than in the second partial region.

The different phases of the gait cycle are characterized by different loads on the sole of a shoe and on the foot and the musculoskeletal system of a wearer. During impact of the foot, for example, large impact forces may act which should be cushioned and dampened by the sole to prevent overstraining of the musculoskeletal system and thus injuries. During push-off, on the other side, the foot should be supported to the effect that the force expended by the wearer may be transmitted to the surface as directly as possible in order to facilitate dynamic push-off. To this end, the sole should not be too "soft" in the sole region where push-off predominantly occurs and it should ensure a good grip on the surface and also sufficiently stabilize the foot of the wearer.

These requirements may be met by an inventive sole by having the first partial region with an increased stiffness and a larger contact area with the surface arranged in such a region of the sole in which push-off during the end of the gait cycle predominantly takes place, and thus facilitate dynamic push-off. For example, the first partial region could extend on the medial side of the sole for improved surface contact and stability due to the larger contact area with the surface.

The second partial region which comprises a smaller stiffness may, on the other hand, be arranged in the region of the sole in which the foot predominantly contacts the surface during impact, such that due to the reduced stiffness impact forces, may at least partially be absorbed or cushioned. For example, the second partial region could extend on the lateral side of the sole, where contact during impact of the foot with the surface may occur.

It is further mentioned that the first and second partial region, and potentially further partial regions, may also be arranged in a different manner according to the intended primary use of the shoe. Hence, by a suitable arrangement of the partial regions, the characteristics of the shoe and its sole may, e.g., be adapted to the sport-specific forces and gait characteristics typically encountered during the performance of such a sporting activity, and so forth.

In this regard, it is to be noted that during different phases of the gait cycle, the protection element may contact the surface in different regions while other regions are not in contact with the surface in a given phase and that the regions of the protection element which contact the surface may "move along the sole" during the gait cycle. Hence, when talking about the protection element having a larger contact area with the surface in the first partial region than in the second partial region when treading down with the sole on the surface, the entire summed-up contact area in which the sole contacts the surface in the first and second partial region, respectively, during a complete gait cycle may be implied. Or the contact area in which the sole contacts the surface in the first and second partial region, respectively, at a particular point in time during the gait cycle, e.g. at the point in time of impact with the surface or at the point in time of push-off with the foot, may be implied.

Reference is again made to the fact that the sole may also comprise more than two partial regions, between which the stiffness of the cushioning element and the contact area of the protection element varies, such that an even more precise controlling of the properties of the sole may be possible. The sole may, for example, comprise three such partial regions or four such partial regions and so forth.

In the following, further design possibilities and optional features of inventive soles are described which may be combined as desired by the skilled person to achieve the respective desired effect with regard to taking influence on the properties of the sole.

The protection element may, for example, be arranged beneath the cushioning element and directly at the cushioning element.

In some embodiments, this arrangement allows providing a compact and structurally uncomplicated sole. In addition, by arranging the protection element directly at the cushioning element, a particularly beneficial interplay between the cushioning element and the protection element may be achieved, such that the above described desired influence on the properties of the different partial regions of the sole may be exerted in a particularly effective manner.

In certain embodiments, the cushioning element may be provided as a midsole or part of a midsole. Also, the protection element may be provided as an outsole or part of an outsole.

Such embodiments may allow doing without additional components of the sole, because a midsole and an outsole are usually planned for the construction of the sole, in particular in the case of sports shoes, anyhow. It is, in particular, possible that the cushioning element forms the midsole whereas the protection element forms the outsole. If, in this case, the outsole is additionally arranged beneath and directly at the midsole, a particularly simple, compact, and inexpensively manufactured sole construction may result.

In principle, however, it is also possible that the midsole and/or the outsole comprise further components or elements. For example, the midsole may comprise a frame at the edge of the sole or similar elements.

It is further possible that the cushioning element comprises a greater density in the first partial region than in the second partial region.

A greater density of the cushioning element in the first partial region may automatically lead to a greater stiffness in the first partial region, and at the same time have the advantage that the density of the cushioning element in the first and second partial region, respectively, may be controlled during the manufacture in a particularly easy manner, e.g. by the filling height of the mold used for the manufacture in the respective parts of the mold or a suitable variation of the base material used for the manufacture.

In some embodiments, the cushioning element is provided as one integral piece.

In further embodiments, the cushioning element comprises two (or more) separate partial elements, wherein the first partial element is at least predominantly arranged in the first partial region of the sole and the second partial element is at least predominantly arranged in the second partial region of the sole.

This may facilitate manufacture of the cushioning element and allow providing cushioning elements which may not be manufactured integrally or only with highly increased manufacturing effort. When talking about the first partial element being "at least predominantly" arranged in the first partial region of the sole, this may, for example, mean that the first partial element is arranged by more than 50%, by more than 80%, or by more than 90% (e.g. relating to the entire area that is occupied by the first partial element within the sole) within the first partial region, but may also extend to some small percentage e.g. into the second partial region or into another (partial) region of the sole. Similar statements also apply to the second partial region.

Herein, it is possible that the first partial element and the second partial element are connected to each other by additional means, e.g. by gluing, welding, fusing or some other fastening method, e.g. in regions in which the first and the second partial element touch each other. Or the first partial element and the second partial element do not comprise an integral bond and are secured in their position relative to one another by the protection element/the outsole and potentially further parts of the sole like, for example, an insole.

It is, in particular, possible that the cushioning element comprises randomly arranged particles of an expanded material, in particular expanded thermoplastic polyurethane ("eTPU") or expanded polyether-block-amide ("ePEBA").

Cushioning elements made from randomly arranged particles of an expanded material, in particular randomly arranged particles of eTPU and/or ePEBA, which may e.g. be fused together at their surfaces, are characterized by a particularly high energy return of the energy that is expended for the deformation of the sole during a gait cycle to the foot of a wearer and can therefore, for example, support performance and endurance of the wearer.

The cushioning element may further comprise a reinforcing element.

Such a reinforcing element can further serve the purpose of locally influencing the properties of the sole, in particular of providing the sole with additional stability in individual regions. In some embodiments, a reinforcing element may be included in the region of the arch of the foot, in particular on the medial side of the arch of the foot e.g. in order to prevent overpronation of the foot during treading down and further such things. Such a reinforcing element may comprise a plastic material, a foil-like material, a textile material, a material constructed from the just-mentioned materials in a layered construction, and so forth.

Herein, it is possible that the reinforcing element extends both into the first partial region of the sole as well as into the second partial region of the sole.

In this way, a coupling effect can be achieved, in particular for the case of a cushioning element made from separately manufactured partial elements, such that the sole provides a continuous wearing sensation during a gait cycle without step-like changes in the properties of the sole that disturb the wearing comfort.

The protection element may be harder to deform, in particular stiffer with respect to bending, in the first partial region than in the second partial region. It may also restrict the stretch of the cushioning element, in particular the stretch of a midsole, according to the stability that is desirable for a given sole.

In this way, the protection element may also contribute to the sole being generally more stable in the first partial region and thus complement and support the design of the cushioning element in this regard.

It is possible that the protection element comprises a plurality of openings and/or regions of thinner material—e.g. in comparison with the thickness of the protection element in the remainder of the second partial region—in the second partial region.

The provision of such openings and/or regions of thinner material may reduce the bending stiffness in the second partial region by way of a simple construction. At the same time weight may be saved and a profiling of the protection element, in particular if it is provided as an outsole, may be achieved.

In some embodiments, the protection element comprises a plurality of openings and/or regions of thinner material—e.g. in comparison with the thickness of the protection element in the remainder of the first partial region—also in the first partial region. On average the openings and/or regions of thinner material in the second partial region may occupy a larger area than the openings and/or regions of thinner material in the first partial region.

For the reason of conciseness, the following discussion will focus on the case of openings in the protection element in the first or second partial region, respectively. However, all statements, as far as applicable, also apply to the case of regions of thinner material in the first or second partial region, respectively.

By providing openings also in the first partial region, e.g. a reduction in weight or a profiling may also be achieved in the first partial region, wherein the increased bending stiffness in the first partial region may be ensured by the fact that the openings in the first partial region occupy on average a smaller area than the openings in the second partial region. The average area of the openings in the first partial region and the second partial region, respectively, may, for example, be determined by choosing a given number of openings in the first partial region and in the second partial region, e.g. 5 openings each or 10 openings each and so forth, whose average area is determined. Or, for example, the area of all openings present in the first partial region and the second partial region, respectively, is averaged.

In some embodiments, individual openings in the first partial region occupy a larger area than individual openings in the second partial region. Since the areas of the openings in the first partial region are, however, on average smaller than the areas of the openings in the second partial region, the protection element is stiffer with respect to bending in the first partial region than in the second partial region, at least averaged over the respective two partial regions.

In addition, the protection element may comprise a plurality of first protrusions in the first partial region which comprise a flattened surface.

Via the flattened surface of the first protrusions, the contact area with the surface when treading down with the sole may be increased in comparison to protrusions with non-flattened surfaces and hence, for example, the grip of the sole in the first partial region may be increased. Simultaneously, through the gaps between the first protrusions, a profiling of the sole may be achieved, in particular if the protection element is provided as an outsole, such that a good grip may also be ensured, for example, on wet surface.

The protection element may further comprise a plurality of second protrusions in the second partial region which, when treading down with the sole on the surface, at least partially press or penetrate into the cushioning element.

To this end, the second protrusions can, for example, be provided (approximately) cone-shaped or pyramid-shaped and so forth, and they may thus allow a good anchoring of the sole in the surface. As already mentioned above, the second partial region of the sole may, for example, be arranged in the region of the sole in which impact of the foot predominantly occurs, such that via the shape of the second protrusions and the at least partial penetration into the cushioning element, the foot of the wearer is tightly anchored in the surface during impact such that a slipping and resulting injuries can be avoided. In addition, a penetration of the second protrusions into the material of the cushioning element in the second partial region may also serve the purpose of locally influencing the shearing capabilities of the cushioning element since the material of the cushioning element is more strongly compressed in places where the second protrusions penetrate into the material of the cushioning element and hence becomes e.g. more resistant to shearing.

In an inventive sole, the first partial region may, in particular, extend on the medial side of the sole. Furthermore, the second partial region may extend on the lateral side of the sole.

With most people, impact of the foot during a typical gait cycle occurs in the lateral region of the heel and the contact area of the foot with the surface moves during the gait cycle across the midfoot region to the medial region of the forefoot where push-off of the foot occurs. By the arrangement of the first partial region on the medial side of the sole, dynamic push-off can hence be facilitated as explained above, while the arrangement of the second partial region on the lateral side may at least partially absorb or alleviate the impact forces during impact in the lateral heel region.

Other arrangements of the first and the second partial regions as well as potential further partial regions are, however, also possible. For example, the first partial region may also constitute the forefoot region of the sole whereas the second partial region constitutes the heel region of the sole. In general, different arrangements of the partial regions on the medial or the lateral side, respectively, and in the forefoot region as well as in the midfoot region and/or the heel region of the sole are envisioned.

A further aspect of the present invention is given by a shoe, in particular a sports shoe, with an inventive sole. In this regard, it is possible within the scope of the invention to arbitrarily combine the described design options and optional features of such an inventive sole, and it is also possible to omit certain aspects if these seem dispensable for the respective shoe or the respective sole.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Certain embodiments of the invention are described in the following detailed description with reference to shoe soles for sports shoes, in particular running shoes. It is, however, emphasized that the present invention is not limited to this. Rather, the present invention may also be employed in soles for other kinds of shoes, in particular soles for hiking shoes, leisure shoes, street shoes, basketball shoes and so forth.

Figure 1B:
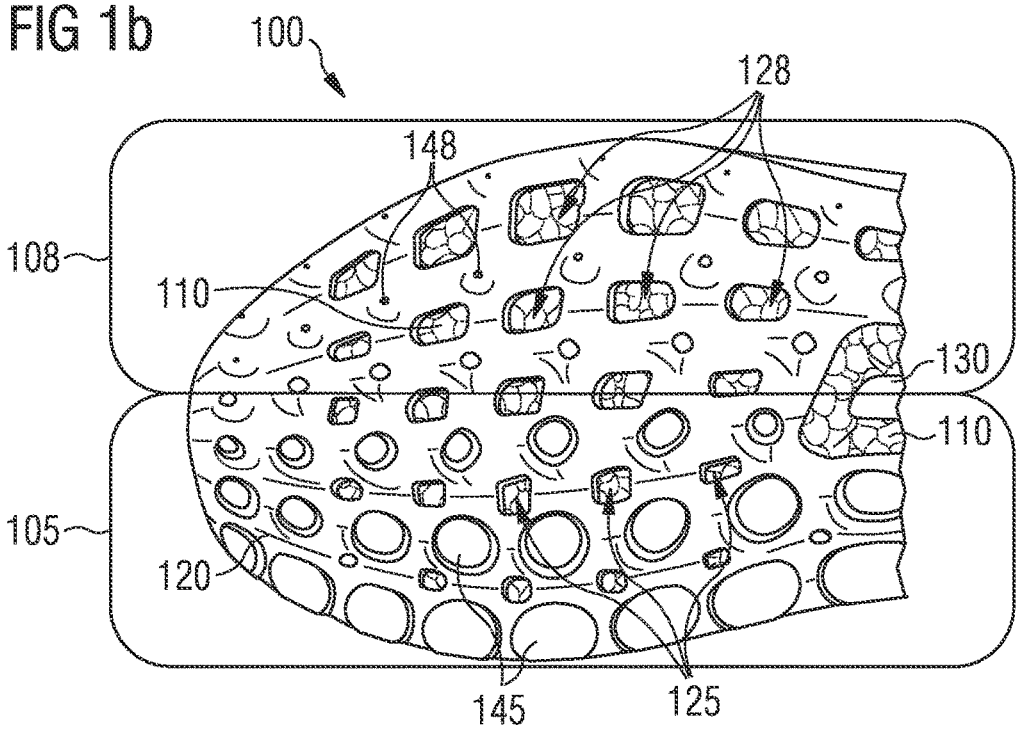
Figure 1C:
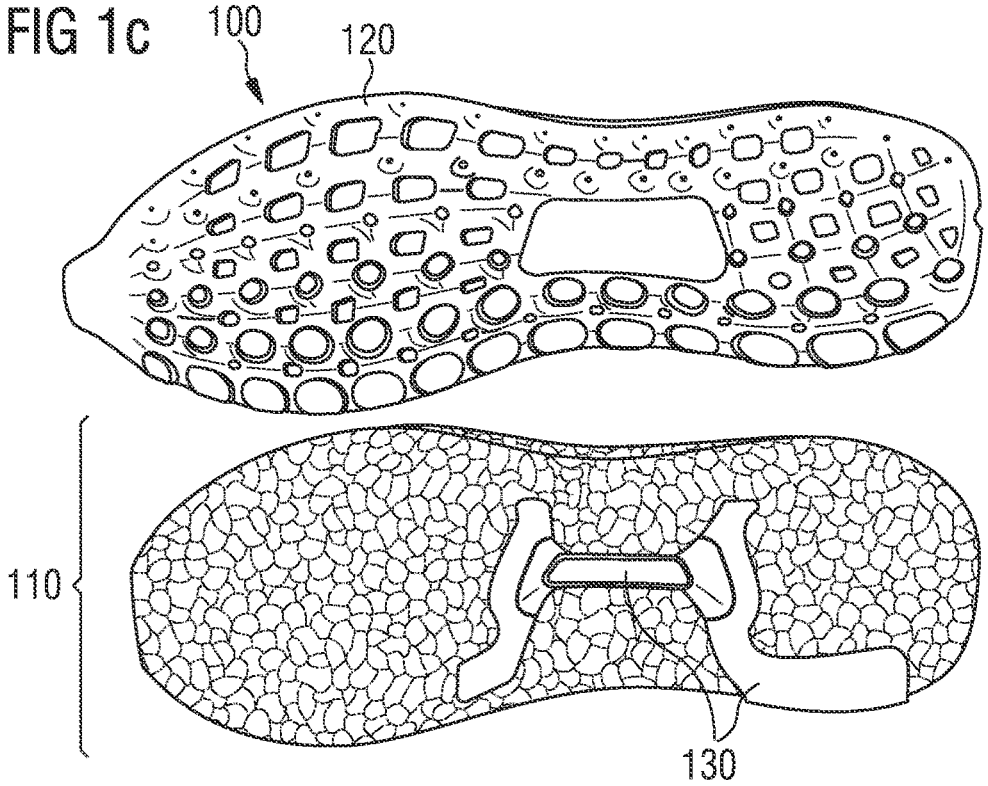

FIGS. 1*a-c* show certain embodiments of an inventive shoe sole 100. The sole 100 may, in particular, be employed in a sports shoe, for example a running shoe. The sole 100 shown here is intended for the left foot of a wearer.

The sole 100 comprises a cushioning element 110, which in the present case is provided as a midsole 110. Furthermore, the sole 100 comprises a protection element 120, which in the present case is provided as an outsole 120. Generally speaking, in some embodiments, the cushioning element 110 may only constitute a part of a midsole and/or the protection element 120 only constitutes a part of an outsole. The case shown here, in which the cushioning elements 110 constitutes the complete midsole 110 and the protection element 120 constitutes the complete outsole 120, allows providing a particularly compact and easily manufactured sole 100. Herein, the outsole 120 is arranged beneath and directly at the midsole 110, such that both elements 110 and 120 of the sole 100 beneficially complement each other in their respective contributions to the desired controlling of the properties of the sole.

To achieve this desired controlling, the sole 100 comprises a first partial region 105 and a second partial region 108. For the sole 100 shown here, the first partial region 105 extends on the medial part of the sole 100 and the second partial region 108 extends on the lateral part of the sole 100, as may be gathered e.g. from FIG. 1*a*.

As already mentioned above, however, in different embodiments of inventive soles (not shown), more than two partial regions may be present and/or the partial regions may be arranged in a different manner.

In the first partial region 105 on the medial side of the sole 100, the midsole 110 may comprise a greater stiffness than in the second partial region 108 on the lateral side of the sole 100. In the case shown here, the midsole 110 is provided as one integral piece. The different stiffnesses of the midsole 110 in the first partial region 105 and the second partial region 108 of the sole 100 may be achieved by different densities of the midsole 110 in the first partial region 105 and the second partial region 108 of the sole 100 and/or the different stiffnesses may be adjusted by a corresponding choice of the base material used for the manufacture in the respective partial regions, and so forth. In particular, the midsole 110 may comprise a greater density in the first partial region 105 than in the second partial region 108.

The midsole 110 may, in particular, be integrally manufactured from randomly arranged particles of expanded thermoplastic polyurethane ("eTPU"), which are fused together at their surfaces. However, randomly arranged particles from expanded polyamide ("ePA") and/or expanded polyether-block-amide ("ePEBA"), for example, which are fused together at their surfaces, are also envisioned. Moreover, for example by adjusting the filling height of a mold used for the manufacture of the midsole 110, the amount of heat transferred to the particles, the amount of pressure exerted on the particles in the mold, or the duration of the particle processing in the different parts of the mold corresponding to the first partial region 105 and the second partial region 108, respectively, the stiffness of the manufactured midsole 110 in the first partial region 105 and the second partial region 108, respectively, may be controlled.

In certain embodiments, the midsole 110 further comprises a reinforcing element 130. In the present case, it serves the stabilization of the sole 100 in the region of the foot arch. The reinforcing element 130 extends both into the first partial region 105 of the sole 100, as well as into the second partial region 108 of the sole 100. The reinforcing element 130 may comprise a plastic material, a textile material, a foil-like material, etc., and it may furthermore also comprise a cavity for receiving an electronic component and so forth.

When treading down with the sole 100 on a surface, the outsole 120 may comprise a larger contact area with the surface in the first partial region 105 on the medial side of the sole 100 than in the second partial region 108 on the lateral side of the sole 100. In the present case, this is achieved by the fact that the outsole 120 comprises a plurality of first protrusions 145 in the first partial region 105 of the sole 100, some or all of which may comprise a flattened surface. In contrast, in the second partial region 108 of the sole 100, the outsole 120 comprises a plurality of second protrusions 148 which provide a smaller contact area with the surface, as may e.g. be particularly clearly seen in FIG. 1*b*. Because the design of the first protrusions 145 and the second protrusions 148 with respect to the contact area with the surface provided by them does not substantially change along the longitudinal axis of the sole 100, at least during most of the time during a gait cycle, the sole comprises a larger contact area with the surface in the first partial region 105 than in the second partial region 108. In any case, the contact area of the sole 100 with the surface summed up over a complete gait cycle may be larger in the first partial region 105 than in the second partial region 108.

It is further to be noted that in the sole 100 shown here, the contact area with the surface provided by the first protrusions 145 and the second protrusions 148, respectively, decreases continuously in a direction from the medial side of the sole 100 to the lateral side of the sole 100, as may e.g. clearly gathered from FIGS. 1*a* and 1*b*, such that a particularly soft transition of the characteristics of the sole during the gait cycle may be effected.

In connection with the lower stiffness of the midsole 110 in the second partial region 108 of the sole 100, the "pointed" design of the second protrusions 148 can have the further effect that, when treading down with the sole 100 on the surface, the second protrusions 148 at least partially penetrate into the material of the midsole 110. This can lead to a particularly good anchoring of the sole 100 on the surface, for example during impact in the lateral heel region, such that a slipping of the foot under the high impact forces during impact on the surface can be avoided.

Moreover, the penetration of the second protrusions 148 into the material of the midsole 110 in the second partial region 108 can also serve the purpose of locally influencing the shearing capability of the midsole 110 since in the regions where the second protrusions 148 penetrate into the material of the midsole 110 the material of the midsole 110 is more strongly compressed and therefore is e.g. more resistant to shearing.

To further facilitate the interplay between the midsole 110 and the outsole 120 in the two partial regions 105 and 108 of the sole 100 as already described several times, the outsole 120 may be provided such that in the first partial region 105, it is harder to deform and in particular stiffer with regard to bending than in the second partial region 108. The outsole 120 may further selectively control or limit the stretch or shearing motions within the midsole 110. In the present case, this is achieved by the fact that the outsole 120 comprises a plurality of openings 125 in the first partial region 105 and it comprises a plurality of openings 128 in the second partial region 108. Herein, the openings 128 in the second partial region 108 occupy on average a larger area than the openings 125 in the first partial region 105, as is clearly visible in FIGS. 1*a-c*. The openings 125 in the first partial region 105 may, for example, also be omitted. Furthermore, in certain embodiments, instead of the openings 125 or 128, the outsole 120 is provided with regions of thinner material (e.g. in comparison with the thickness of the outsole 120 in the remaining areas, in particular in the areas surrounding the regions of thinner material) there.

Figure 2:
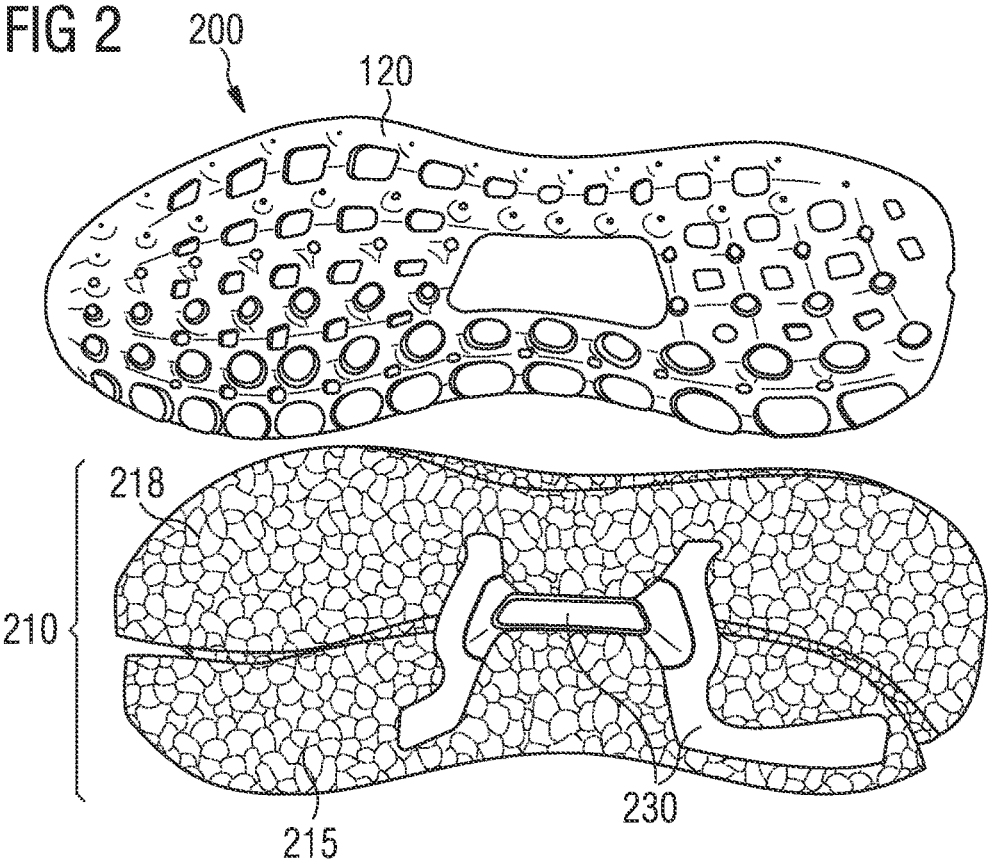
FIG. 2 are bottom views of shoe soles, according to additional embodiments of the present invention.

FIG. 2 shows additional embodiments of an inventive sole 200, which is a modification of the sole 100 shown in FIGS. 1*a-c*. More precisely, the sole 200 differs from the sole 100 by the construction of its midsole 210. Regarding the remaining elements and features of the sole 200, the statements and explanations put forth with respect to the sole 100 equally apply and will therefore not be discussed again for the sake of conciseness.

For the sole 200, its midsole 210 comprises two separate partial elements 215 and 218, as can be gathered from FIG. 2, wherein the first partial element 215 is predominantly arranged in the first partial region 105 of the sole 200 and the second partial element 218 is predominantly arranged in the second partial region 108 of the sole 200, as will become apparent, e.g., from a comparison with FIG. 1*a* (again, the first partial region and the second partial region of the sole 200 are the same as the first partial region 105 and the second partial region 108 of the sole 100 and will therefore be referenced by the same reference numerals). The varying stiffness of the two partial elements 215 and 218, and therefore the varying stiffness of the midsole 210 in the first partial region 105 and the second partial region 108, is achieved by the fact that the first partial element 215 comprises a greater density than the second partial element 218. Both partial elements 215 and 218 are manufactured from randomly arranged particles of eTPU which are fused together at their surfaces. However, e.g. randomly arranged particles from ePA and/or ePEBA, which are fused together at their surfaces, are also envisioned.

The two separate partial elements 215 and 218 may not be integrally bonded to each other. Rather, the two partial elements 215 and 218 may be secured in their position relative to one another by the outsole 120 in the assembled state of the sole 200. In certain embodiments, the two partial elements 215 and 218 may be integrally bonded to each other, for example glued, welded or fused, to improve stability and durability of the sole 200.

The midsole 210 also comprises a reinforcing element 230. It may serve the stabilization of the sole 200 in the region of the foot arch, and it may further serve to couple the first partial element 215 and the second partial element 218 together to a certain degree. To this end, the reinforcing element 230 extends both into the first partial element 215, and hence into the first partial region 105 of the sole 200, as well as into the second partial element 218, and hence into the second partial region 108 of the sole 200.

In the following, further examples are described to facilitate the understanding of the invention:

1. Sole (100; 200) for a shoe, in particular a sports shoe, comprising:
   a. a cushioning element (110; 210); and
   b. a protection element (120), wherein
   c. the sole (100; 200) comprises a first partial region (105) and a second partial region (108); wherein
   d. the cushioning element (110; 210) comprises a greater stiffness in the first partial region (105) than in the second partial region (108), and wherein
   e. when treading down with the sole (100; 200) on a surface, the protection element (120) comprises a larger contact area with the surface in the first partial region (105) than in the second partial region (108).
2. Sole (100; 200) according to the preceding example, wherein the protection element (120) is arranged beneath the cushioning element (110; 210) and directly at the cushioning element (110; 210).
3. Sole (100; 200) according to one of the preceding examples, wherein the cushioning element (110; 210) is provided as a midsole (110; 210) or part of a midsole (110; 210).
4. Sole (100; 200) according to one of the preceding examples, wherein the protection element (120) is provided as an outsole (120) or part of an outsole (120).
5. Sole (100; 200) according to one of the preceding examples, wherein the cushioning element (110; 210) comprises are greater density in the first partial region (105) than in the second partial region (108).
6. Sole (100; 200) according to one of the preceding examples, wherein the cushioning element (110; 210) comprises randomly arranged particles of an expanded material, in particular expanded thermoplastic polyurethane or expanded polyether-block-amide.
7. Sole (100; 200) according to one of the preceding examples, wherein the cushioning element (110; 210) further comprises a reinforcing element (130; 230).
8. Sole (100; 200) according to the preceding example, wherein the reinforcing element (130; 230) extends both into the first partial region (105) of the sole (100; 200) as well as into the second partial region (108) of the sole (100; 200).
9. Sole (100; 200) according to one of the preceding examples, wherein the protection element (120) is harder to deform, in particular stiffer with respect to bending, in the first partial region (105) than in the second partial region (108).
10. Sole (100; 200) according to one of the preceding examples, wherein the protection element (120) comprises a plurality of openings (128) and/or regions of thinner material in the second partial region (108).
11. Sole (100; 200) according to the preceding example, wherein the protection element (120) comprises a plurality of openings (125) and/or regions of thinner material also in the first partial region (105) and wherein on average the openings (128) and/or regions of thinner material in the second partial region (108) occupy a larger area than the openings (125) and/or regions of thinner material in the first partial region (105).
12. Sole (100; 200) according to one of the preceding examples, wherein the protection element (120) comprises a plurality of first protrusions (145) in the first partial region (105) which comprise a flattened surface.
13. Sole (100; 200) according to one of the preceding examples, wherein the protection element (120) comprises a plurality of second protrusions (148) in the second partial region (108) which, when treading down with the sole (100; 200) on the surface, at least partially penetrate into the cushioning element (110; 210).
14. Sole (100; 200) according to one of the preceding examples, wherein the first partial region (105) extends on the medial side of the sole (100; 200).
15. Sole (100; 200) according to one of the preceding examples, wherein the second partial region (108) extends on the lateral side of the sole (100; 200).
16. Shoe, in particular sports shoe, with a sole (100; 200) according to one of the preceding examples 1-15.

Different arrangements of the components depicted in the drawings or described above, as well as components and steps not shown or described are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications may be made without departing from the scope of the claims below.

That which is claimed is:

1. A sole for a shoe comprising a first partial region and a second partial region;

a cushioning element comprising randomly arranged particles of an expanded material, wherein the cushioning element is arranged within at least a portion of the first partial region and within at least a portion of the second partial region; and a protection element arranged within at least a portion of the first partial region and within at least a portion of the second partial region, wherein the protection element comprises at least one first protrusion having a flattened surface in the first partial region and at least one second protrusion having a cone-shape or pyramid-shape in the second partial region, wherein the at least one first protrusion has a different shape than the at least one second protrusion, wherein the at least one second protrusion at least partially presses into the cushioning element when a wearer treads down on the sole, and wherein the at least one first protrusion has a greater contact area with a surface when treading down than the at least one second protrusion.

2. The sole according to claim 1, wherein the protection element is arranged beneath the cushioning element and directly at the cushioning element.

3. The sole according to claim 1, wherein the sole further comprises a midsole, and the cushioning element forms at least a portion of the midsole.

4. The sole according to claim 1, wherein the sole further comprises an outsole, and the protection element forms at least a portion of the outsole.

5. The sole according to claim 1, wherein the cushioning element comprises a greater density in the first partial region than in the second partial region.

6. The sole according to claim 1, wherein the particles of the expanded material are selected from a group consisting of expanded thermoplastic polyurethane particles and expanded polyether-block-amide particles.

7. The sole according to claim 1, wherein the cushioning element further comprises a reinforcing element.

8. The sole according to claim 7, wherein the reinforcing element extends into the first partial region and the second partial region.

9. The sole according to claim 1, wherein the protection element comprises a greater bending stiffness in the first partial region than in the second partial region.

10. The sole according to claim 1, wherein the first partial region extends on at least a portion of a medial side of the sole.

11. The sole according to claim 1, wherein the second partial region extends on at least a portion of a lateral side of the sole.

12. A shoe with a sole according to claim 1.

13. A sole for a shoe comprising a first partial region and a second partial region;

a cushioning element comprising randomly arranged particles of an expanded material, wherein the cushioning element is arranged within at least a portion of the first partial region and within at least a portion of the second partial region; and a protection element arranged within at least a portion of the first partial region and within at least a portion of the second partial region;

wherein the protection element comprises a plurality of openings in the first partial region and in the second partial region, at least one first protrusion in the first partial region and at least one second protrusion in the second partial region, wherein on average, the plurality of openings in the second partial region occupy a larger area than the plurality of openings in the first partial region, wherein the at least one second protrusion at least partially presses into the cushioning element when a wearer treads down on the sole, wherein the at least one first protrusion has a flattened surface and the at least one second protrusion has a cone-shape or pyramid-shape, wherein the at least one first protrusion has a different shape than the at least one second protrusion, and wherein the at least one first protrusion has a greater contact area with a surface when treading down than the at least one second protrusion.

14. The sole according to claim 13, wherein the particles of the expanded material are selected from a group consisting of expanded thermoplastic polyurethane particles and expanded polyether-block-amide particles.

15. The sole according to claim 13, wherein the protection element comprises a greater bending stiffness in the first partial region than in the second partial region.

16. The sole according to claim 13, wherein the cushioning element comprises a greater density in the first partial region than in the second partial region.

17. A sole for a shoe comprising a first partial region which extends on at least a portion of a medial side of the sole and a second partial region which extends on at least a portion of a lateral side of the sole;

a cushioning element comprising randomly arranged particles of an expanded material, wherein the cushioning element is arranged within at least a portion of the first partial region and within at least a portion of the second partial region; and a protection element arranged within at least a portion of the first partial region and within at least a portion of the second partial region, wherein the protection element comprises at least one first protrusion having a flattened surface in the first partial region and at least one second protrusion having a cone-shape or pyramid-shape in the second partial region, wherein the at least one first protrusion has a different shape than the at least one second protrusion; wherein the at least one second protrusion at least partially presses into the cushioning element when a wearer treads down on the sole, and wherein the at least one first protrusion has a greater contact area with a surface when treading down than the at least one second protrusion.

18. The sole according to claim 17, wherein the protection element comprises a greater bending stiffness in the first partial region than in the second partial region.

19. The sole according to claim 17, wherein the cushioning element comprises a greater density in the first partial region than in the second partial region.

20. The sole according to claim 17, wherein the cushioning element further comprises a reinforcing element which extends into the first partial region and the second partial region.

21. The sole according to claim 17, wherein the particles of the expanded material are selected from a group consisting of expanded thermoplastic polyurethane particles and expanded polyether-block-amide particles.

* * * * *